US009388704B2

(12) United States Patent
Lohaus et al.

(10) Patent No.: US 9,388,704 B2
(45) Date of Patent: Jul. 12, 2016

(54) VANE ARRAY WITH ONE OR MORE NON-INTEGRAL PLATFORMS

(71) Applicants: Andrew S. Lohaus, Winter Park, FL (US); Christian Xavier Campbell, Charlotte, NC (US); Samuel R. Miller, Jr., Port St. Lucie, FL (US); John J. Marra, Winter Springs, FL (US)

(72) Inventors: Andrew S. Lohaus, Winter Park, FL (US); Christian Xavier Campbell, Charlotte, NC (US); Samuel R. Miller, Jr., Port St. Lucie, FL (US); John J. Marra, Winter Springs, FL (US)

(73) Assignee: Siemens Energy, Inc., Orlando, FL (US)

( * ) Notice: Subject to any disclaimer, the term of this patent is extended or adjusted under 35 U.S.C. 154(b) by 448 days.

(21) Appl. No.: 14/078,599

(22) Filed: Nov. 13, 2013

(65) Prior Publication Data

US 2015/0132122 A1 May 14, 2015

(51) Int. Cl.

| | |
|---|---|
| ***F01D 9/04*** | (2006.01) |
| ***F01D 25/24*** | (2006.01) |
| ***F01D 5/14*** | (2006.01) |
| ***F01D 5/30*** | (2006.01) |
| ***F01D 11/00*** | (2006.01) |

(52) U.S. Cl.

CPC ..... *F01D 9/042* (2013.01); *F01D 5/143* (2013.01); *F01D 5/3053* (2013.01); *F01D 11/008* (2013.01); *F01D 25/246* (2013.01); *F05D 2240/80* (2013.01)

(58) Field of Classification Search

CPC ..... F01D 5/143; F01D 5/3035; F01D 9/042; F01D 11/008; F01D 25/246; F05D 2240/80

See application file for complete search history.

(56) References Cited

U.S. PATENT DOCUMENTS

| | | | | |
|---|---|---|---|---|
| 2,661,147 | A | 12/1953 | Anderson | |
| 3,442,442 | A | 5/1969 | Seiwert | |
| 4,465,433 | A | 8/1984 | Bischoff | |
| 5,022,818 | A * | 6/1991 | Scalzo | F04D 29/542 415/189 |
| 6,017,186 | A | 1/2000 | Hoeger et al. | |
| 6,139,264 | A * | 10/2000 | Schilling | F04D 29/164 415/174.2 |
| 6,283,713 | B1 | 9/2001 | Harvey et al. | |
| 6,296,443 | B1 * | 10/2001 | Newman | F01D 9/042 415/189 |
| 6,561,761 | B1 | 5/2003 | Decker et al. | |
| 6,669,445 | B2 | 12/2003 | Staubach et al. | |
| 7,013,652 | B2 | 3/2006 | Gebhardt | |
| 7,134,842 | B2 | 11/2006 | Tam et al. | |
| 7,220,100 | B2 | 5/2007 | Lee et al. | |
| 7,354,243 | B2 | 4/2008 | Harvey | |
| 7,465,155 | B2 | 12/2008 | Nguyen | |
| 7,604,456 | B2 | 10/2009 | Schiavo, Jr. et al. | |
| 8,251,652 | B2 | 8/2012 | Campbell et al. | |
| 8,277,177 | B2 | 10/2012 | Liang | |
| 8,292,580 | B2 | 10/2012 | Schiavo et al. | |

(Continued)

FOREIGN PATENT DOCUMENTS

| | | |
|---|---|---|
| EP | 1126132 A2 | 8/2001 |
| EP | 1548232 A1 | 6/2005 |

(Continued)

*Primary Examiner* — Igor Kershteyn

(57) ABSTRACT

A vane array adapted to be coupled to a vane carrier within a gas turbine engine is provided comprising: a plurality of elongated airfoils comprising at least a first airfoil and a second airfoil located adjacent to one another; a U-ring; first connector structure for coupling a radially inner end section of each of the first and second airfoils to the U-ring; second connector structure for coupling a radially outer end section of each of the first and second airfoils to the vane carrier; a platform extending between the first and second airfoils; and platform connector structure for coupling the platform to one of the U-ring and the vane carrier.

20 Claims, 4 Drawing Sheets

(56) References Cited

U.S. PATENT DOCUMENTS

| | | | |
|---|---|---|---|
| 2007/0177973 | A1 | 8/2007 | Seki et al. |
| 2007/0258810 | A1 | 11/2007 | Aotsuka et al. |
| 2007/0258818 | A1 | 11/2007 | Allen-Bradley et al. |
| 2008/0025842 | A1 | 1/2008 | Marini et al. |
| 2009/0304516 | A1 | 12/2009 | Couch et al. |
| 2010/0172760 | A1 | 7/2010 | Ammann |
| 2011/0243709 | A1 | 10/2011 | El-Aini et al. |
| 2012/0070310 | A1 | 3/2012 | Ahmad |
| 2013/0004331 | A1 | 1/2013 | Beeck |
| 2013/0064667 | A1 | 3/2013 | Campbell et al. |

FOREIGN PATENT DOCUMENTS

| | | | |
|---|---|---|---|
| EP | 2098689 | A2 | 9/2009 |
| FR | 2715968 | A1 | 8/1995 |
| GB | 749577 | A | 5/1956 |

* cited by examiner

VANE ARRAY WITH ONE OR MORE NON-INTEGRAL PLATFORMS

STATEMENT REGARDING FEDERALLY SPONSORED DEVELOPMENT

This invention was made with U.S. Government support under Contract Number DE-FC26-05NT42644 awarded by the U.S. Department of Energy. The U.S. Government has certain rights to this invention.

FIELD OF THE INVENTION

The present invention relates to a vane array and, more specifically, to a vane array having one or more non-integral platforms.

BACKGROUND OF THE INVENTION

A gas turbine engine typically includes a compressor section, a combustor, and a turbine section. The compressor section compresses ambient air that enters an inlet. The combustor combines the compressed air with a fuel and ignites the mixture creating combustion products defining a working fluid. The working fluid travels to the turbine section where it is expanded to produce a work output. Within the turbine section are rows of stationary vanes directing the working fluid to rows of rotating blades coupled to a rotor. Each pair of a row of vanes and a row of blades forms a stage in the turbine section.

Advanced gas turbines with high performance requirements attempt to reduce the aerodynamic losses as much as possible in the turbine section. This in turn results in improvement of the overall thermal efficiency and power output of the engine.

SUMMARY OF THE INVENTION

In accordance with a first aspect of the present invention, a vane array adapted to be coupled to a vane carrier within a gas turbine engine is provided comprising: a plurality of elongated airfoils comprising at least a first airfoil and a second airfoil located adjacent to one another; a U-ring; first connector structure for coupling a radially inner end section of each of the first and second airfoils to the U-ring; second connector structure for coupling a radially outer end section of each of the first and second airfoils to the vane carrier; and a first platform extending between the first and second airfoils and positioned near the radially inner end sections of the first and second airfoils; a second platform extending between the first and second airfoils and positioned near the radially outer end sections of the first and second airfoils; third connector structure for coupling the first platform to the U-ring; and fourth connector structure for coupling the second platform to the vane carrier.

The radially inner end section of each of the first and second airfoils may comprise connector arms extending radially inward.

The first connector structure may comprise first connecting pins.

The radially outer end section of each of the first and second airfoils may comprise connector hooks.

The second connector structure may comprise second connecting pins.

The first platform may comprise a first contoured main body and first mounting lugs coupled to the first contoured main body.

The third connector structure may comprise pins that extend through the first mounting lugs and are coupled to the U-ring. In an alternative embodiment, the third connector structure comprises corresponding slots in the U-ring for receiving the mounting lugs and wherein pins are not provided.

The first mounting lugs may be located generally mid-way between the first and second airfoils.

The second platform may comprise a second contoured main body and further mounting lugs coupled to the second contoured main body.

The fourth connector structure may comprise pins that extend through the further mounting lugs and are coupled to the vane carrier. In an alternative embodiment, the fourth connector structure comprises corresponding slots in the vane carrier for receiving the mounting lugs and wherein pins are not provided.

The further mounting lugs may be located generally mid-way between the first and second airfoils.

One or both of the first and second platforms may be contoured.

In accordance with a second aspect of the present invention, a vane array adapted to be coupled to a vane carrier within a gas turbine engine is provided comprising: a plurality of elongated airfoils comprising at least a first airfoil and a second airfoil located adjacent to one another; a U-ring; first connector structure for coupling a radially inner end section of each of the first and second airfoils to the U-ring; second connector structure for coupling a radially outer end section of each of the first and second airfoils to the vane carrier; a platform extending between the first and second airfoils; and platform connector structure for coupling the platform to one of the U-ring and the vane carrier.

The radially inner end section of each of the first and second airfoils may comprise connector arms extending radially inward.

The first connector structure may comprise first connecting pins.

The radially outer end section of each of the first and second airfoils may comprise connector hooks.

The second connector structure may comprise second connecting pins.

The platform may comprise a contoured main body and mounting lugs coupled to the contoured main body.

The platform connector structure may comprise pins that extend through the mounting lugs and are received in one of the U-ring and the vane carrier. In an alternative embodiment, the platform connector structure comprises corresponding slots in one of the U-ring and the vane carrier for receiving the mounting lugs.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

A gas turbine engine may comprise a compressor section, a combustor and a turbine section. The compressor section compresses ambient air. The combustor combines the compressed air with a fuel and ignites the mixture creating combustion products comprising hot working gases defining a working fluid. The working fluid travels to the turbine section. Within the turbine section are rows of stationary vanes and rows of rotating blades coupled to a rotor, wherein each pair of rows of vanes and blades forms a stage in the turbine section.

Figure 1:
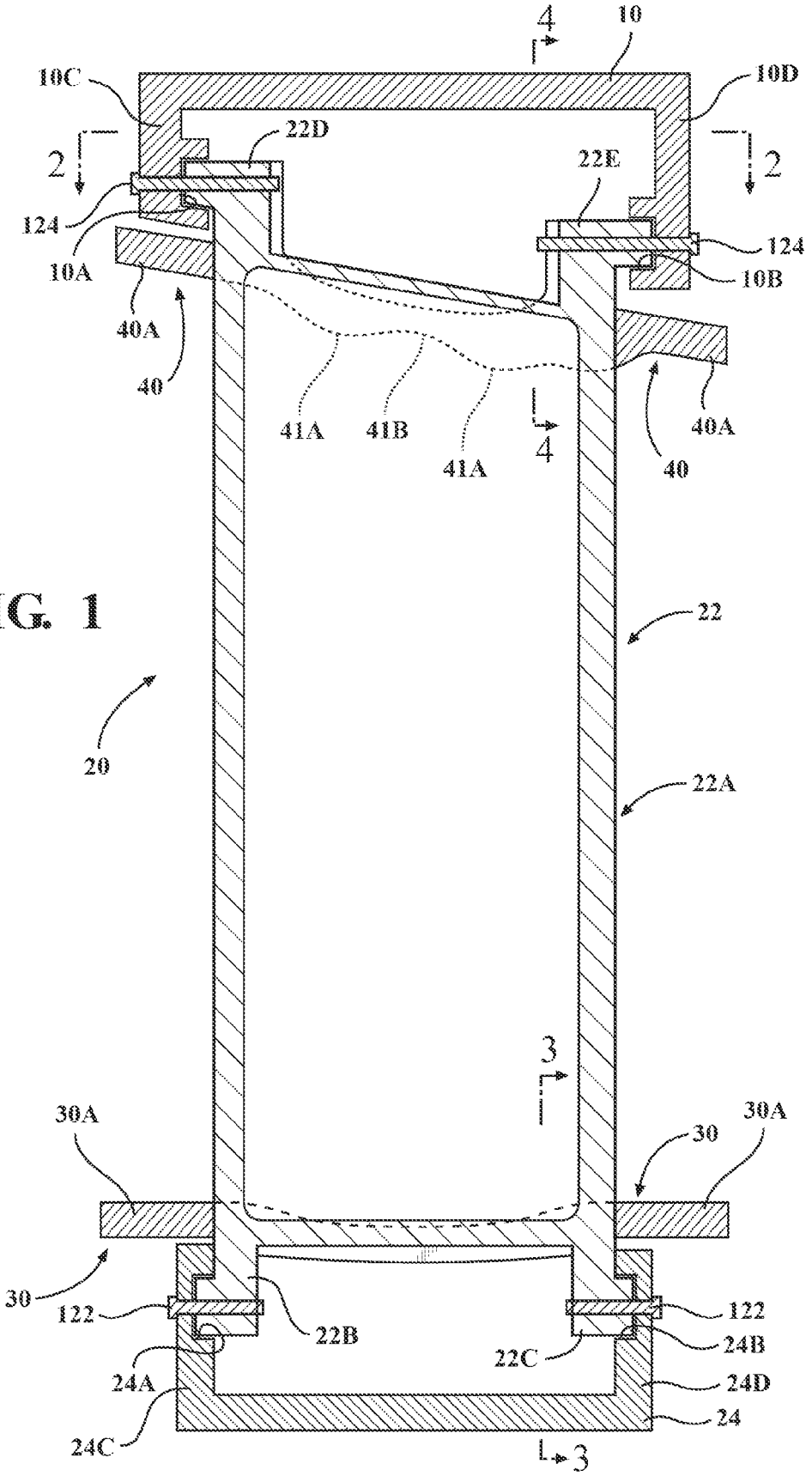
FIG. 1 is a cross sectional view illustrating an airfoil and a U-ring of a vane array coupled to a vane carrier within a gas turbine engine.
Figure 4:
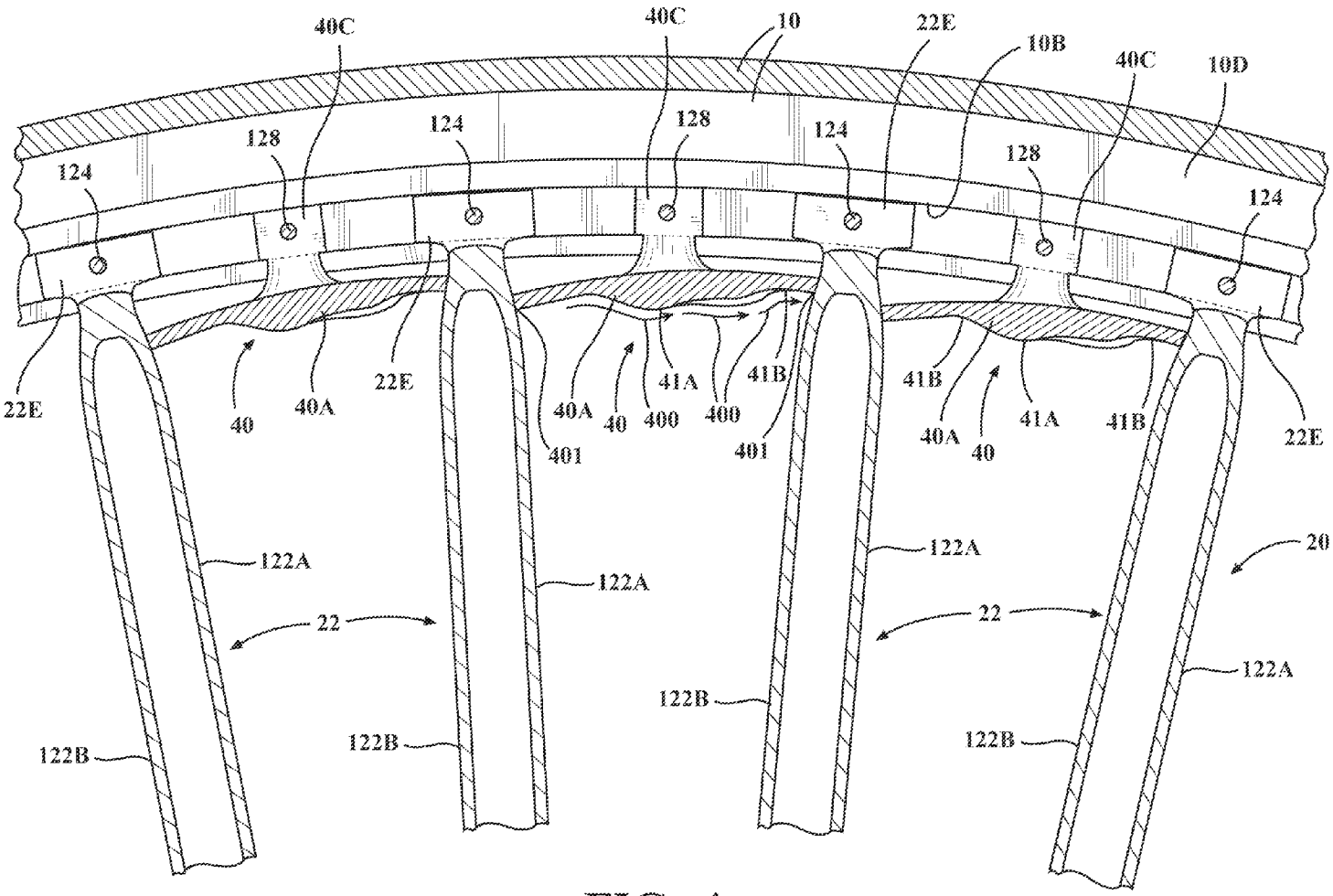
FIG. 4 is a view taken along section line 4-4 in FIG. 1.

The turbine section comprises a fixed turbine casing (not shown), which houses the vanes, blades and rotor. For each row of vanes, there is a corresponding vane carrier 10, one of which is illustrated in FIG. 1, fixed to the turbine casing. The vane carrier 10 may comprise two 180 degree halves that meet at a pair of horizontal flanges (not shown) so as to define a generally ring-shaped vane carrier 10. As illustrated in FIGS. 1 and 4, the vane carrier 10 comprises first and second circumferentially extending tracks 10A and 10B defined by slots or recesses within first and second sidewalls 10C and 10D of the vane carrier 10.

In accordance with the present invention, a vane array 20 is coupled to each vane carrier 10 such that the vane array 20 defines a row of vanes. One such vane array 20 is illustrated in FIGS. 1-4. Each vane array 20 comprises a plurality of circumferentially spaced-apart elongated airfoils 22 and a U-ring 24.

Each airfoil 22 may comprise a main body portion 22A, which is exposed to the working fluid moving through the turbine section, a radially inner end section defined by first and second connector arms 22B and 22C extending inwardly from the main body portion 22A and a radially outer end section defined first and second connector hooks 22D and 22E extending outwardly from the main body portion 22A, see FIG. 1. Each main body portion 22A includes a generally concave sidewall 122A defining a pressure side of the airfoil 22 and an opposing generally convex sidewall 122B defining a suction side of the airfoil 22, see FIG. 2.

Figure 3:
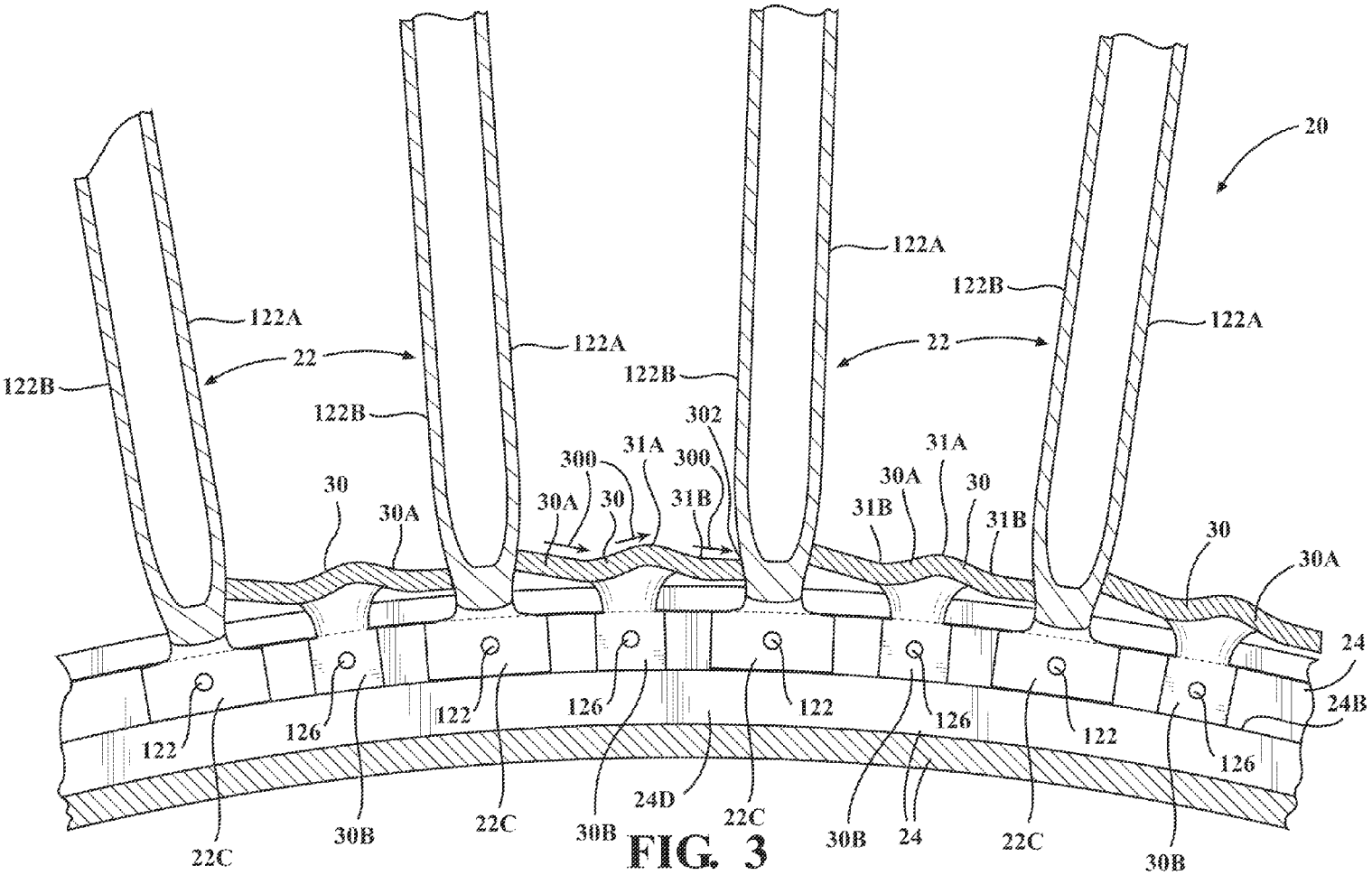
FIG. 3 is view taken along section line 3-3 in FIG. 1.

The U-ring 24 has a generally U-shape in cross-section, i.e., in a radial and axial plane, and may comprise two 180 degree halves that, when positioned such that their ends are directly across from and adjacent to one another, define a U-ring 24 having a ring shape. As illustrated in FIGS. 1 and 3, the U-ring 24 comprises first and second circumferentially extending tracks 24A and 24B defined by slots or recesses within first and second sidewalls 24C and 24D of the U-ring 24.

During assembly of the vane array 20, the first and second connector arms 22B and 22C of each airfoil 22 are inserted into and slid along the tracks 24A and 24B in the first and second sidewalls 24C and 24D of the U-ring 24 until the airfoil 22 is properly located along the tracks 24A and 24B. First connector structure comprising pins 122 may be provided and inserted through corresponding bores in the connector arms 22B and 22C and the U-ring sidewalls 24C and 24D for coupling each airfoil 22 to the U-ring 24 and maintaining the airfoil 22 in its proper location within the U-ring 24.

Also during assembly of the vane array 20, the first and second connector hooks 22D and 22E of each airfoil 22 are inserted into and slid along the tracks 10A and 10B within the first and second sidewalls 10C and 10D of the vane carrier 10 until the airfoil 22 is properly located along the tracks 10A and 10B. Second connector structure comprising pins 124 may be provided and inserted through corresponding bores in the connector hooks 22D and 22E and the vane carrier sidewalls 10C and 10D for coupling each airfoil 22 to the vane carrier 10 and maintaining the airfoil 22 in its proper location within the vane carrier 10.

The vane array 20 may also comprise a plurality of first platforms 30 and second platforms 40, see FIGS. 1-4. Each first platform 30 may comprise a first main body 30A and first and second axially spaced apart mounting lugs (only the second mounting lugs 30B are shown in FIG. 3), which are coupled to and located radially inwardly of the first main body 30A. In the illustrated embodiment, each first main body 30A extends continuously between a pair of directly adjacent airfoils 22 and is positioned near the first and second connector arms 22B and 22C of the adjacent airfoils 22, see FIGS. 1 and 3. The first and second mounting lugs may be located generally mid-way between the adjacent airfoils 22. The first platforms 30 define a lower boundary, i.e., an inner boundary, defining a portion of a flow path for the working fluid passing through the turbine section.

In the illustrated embodiment, each first platform 30 may comprise a contoured first main body 30A as illustrated in FIGS. 1 and 3 having contours such as one or more elevated peaks 31A and/or one or more depressed troughs 31B. A flow path of the working fluid moving over an outer surface of a first platform 30 from a concave sidewall 122A of one airfoil 22 to a convex sidewall 122B of an adjacent airfoil is illustrated by arrows 300 in FIG. 3. At a centrally located peak 31A, the working fluid flows smoothly over the peak 31A as there are no gaps in the platform 30 in the area between the concave and convex sidewalls 122A and 122B. Further, an intersection 302 between the first platform main body 30A and the convex sidewall 122B of the airfoil 22 can be designed by a designer at any angle.

During assembly of the vane array 20, the first and second mounting lugs of each first platform 30 are inserted into and slid along the tracks 24A and 24B in the first and second sidewalls 24C and 24D of the U-ring 24 until the platform 30 is properly located along the tracks 24A and 24B. A first platform 30 is assembled to the U-ring 24 between each pair of adjacent airfoils 22, see FIG. 3. Third connector structure comprising pins 126 may be provided and inserted through corresponding bores in the first and second lugs and the U-ring sidewalls 24C and 24D for coupling the first and second lugs of the first platforms 30 to the U-ring 24 and maintaining each platform 30 in its proper location within the U-ring 24. In an alternative embodiment, pins 126 are not provided and adjacent airfoils 22 function to maintain a first platform 30 in position between the adjacent airfoils 22, i.e., only the tracks 24A and 24B function as the third connector structure.

Figure 2:
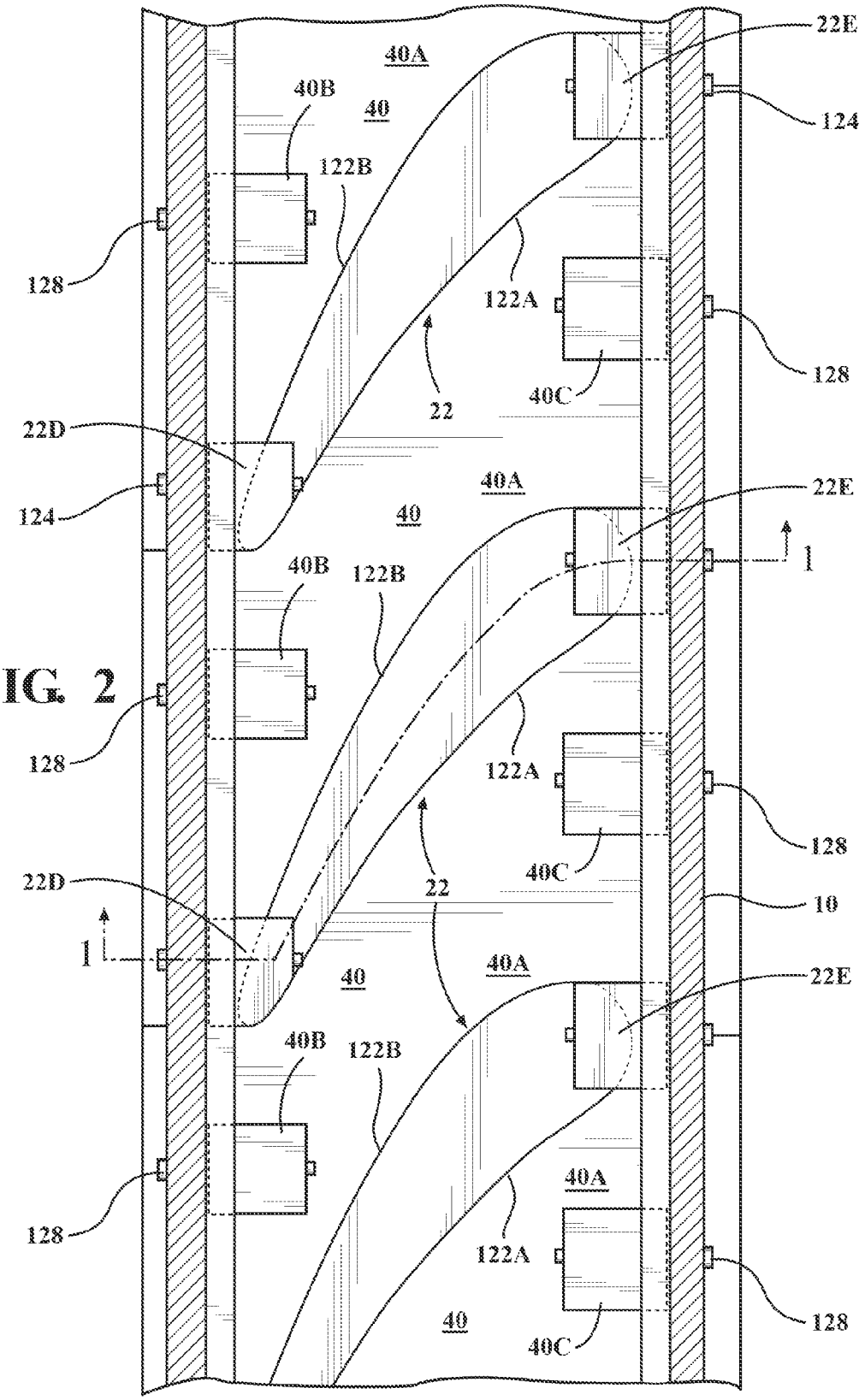
FIG. 2 is a view, partially in cross section, of a portion of a vane array of the present invention.

Each second platform 40 may comprise a second main body 40A and third and fourth axially spaced apart mounting lugs 40B and 40C coupled to and located radially outwardly of the second main body 40A, see FIGS. 1, 2 and 4. Each second platform 40 extends continuously between a pair of directly adjacent airfoils 22 and is positioned near the first and second connector hooks 22D and 22E of the adjacent airfoils 22. The third and fourth mounting lugs 40B and 40C may be located generally mid-way between the adjacent airfoils 22, see FIG. 2. The second platforms 40 define an upper boundary, i.e., an outer boundary, defining a portion of a flow path for the working fluid passing through the turbine section.

During assembly of the vane array 20, the third and fourth mounting lugs 40B and 40C of each second platform 40 are inserted into and slid along the tracks 10A and 10B in the first and second sidewalls 10C and 10D of the vane carrier 10 until the platform 40 is properly located along the tracks 10A and 10B. A second platform 40 is assembled to the vane carrier 10 between each pair of adjacent airfoils 22, see FIG. 4. Fourth connector structure comprising pins 128 may be provided and inserted through corresponding bores in the third and fourth mounting lugs 40B and 40C and the vane carrier sidewalls 10C and 10D for coupling the third and fourth lugs 40B and 40C of the second platforms 40 to the vane carrier 10 and maintaining each platform 40 in its proper location within the vane carrier 10. In an alternative embodiment, pins 128 are not provided and adjacent airfoils 22 function to maintain a second platform 40 in position between the adjacent airfoils 22, i.e., only the tracks 10A and 10B function as the fourth connector structure.

The second platforms 40 may comprise a contoured second main body 40A as illustrated in FIGS. 1 and 4 having contours such as one or more elevated peaks 41A and/or one or more depressed troughs 41B. A flow path of the working fluid moving over an outer surface of a second platform 40 from a concave sidewall 122A of one airfoil 22 to a convex sidewall 122B of an adjacent airfoil is illustrated by arrows 400 in FIG. 4. At a centrally located peak 41A, the working fluid flows smoothly over the peak 41A as there are no gaps in the platform 40 in the area between the concave and convex sidewalls 122A and 122B. Further, an intersection 401 between the second platform main body 40A and the convex sidewall 122B of the airfoil 22 can be designed by a designer at any angle.

As noted above, each of the first and second platforms 30, 40 extends continuously from a concave sidewall 122A of one airfoil 22 to a generally convex sidewall 122B of a directly adjacent airfoil 22, see FIGS. 3 and 4. Hence, there are no gaps or lines of separation in the first and second platforms 30, 40 between adjacent airfoils 22. In the prior art, adjacent vanes may comprise integral platforms that meet at a location creating gaps generally half-way between airfoils of the adjacent vanes, wherein each gap may provide a path through which hot working fluid may pass, which may cause damage to sections of the vanes located beneath the platforms and not within the path of the working fluid. Further, the mating structure of adjacent platforms creating the gaps may cause disturbances in the flow of the working fluid moving between the adjacent airfoils. In the present invention, because the platforms 30, 40 extend continuously between adjacent concave and convex sidewalls 122A and 122B of adjacent airfoils 22, it is believed that these disadvantages are avoided.

While the airfoils 22 are illustrated as being hollow, they may be solid. While the first and second platforms 30 and 40 are illustrated as being solid, they may be provided with cooling passages.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A vane array adapted to be coupled to a vane carrier within a gas turbine engine comprising:

a plurality of elongated airfoils comprising at least a first airfoil and a second airfoil located adjacent to one another;

a U-ring;

first connector structure for coupling a radially inner end section of each of the first and second airfoils to said U-ring;

second connector structure for coupling a radially outer end section of each of the first and second airfoils to said vane carrier;

a first platform extending between said first and second airfoils and positioned near said radially inner end sections of the first and second airfoils;

a second platform extending between said first and second airfoils and positioned near said radially outer end sections of the first and second airfoils;

third connector structure for coupling said first platform to said U-ring; and fourth connector structure for coupling said second platform to said vane carrier.

2. The vane array as set out in claim 1, wherein said radially inner end section of each of said first and second airfoils comprises connector arms extending radially inward.

3. The vane array as set out in claim 2, wherein said first connector structure comprises first connecting pins.

4. The vane array as set out in claim 1, wherein said radially outer end section of each of said first and second airfoils comprises connector hooks.

5. The vane array as set out in claim 4, wherein said second connector structure comprises second connecting pins.

6. The vane array as set out in claim 1, wherein said first platform comprises a first contoured main body and first mounting lugs coupled to said first contoured main body.

7. The vane array as set out in claim 6, wherein said third connector structure comprises pins that extend through said first mounting lugs and are coupled to the U-ring.

8. The vane array as set out in claim 7, wherein said first mounting lugs are located generally mid-way between said first and second airfoils.

9. The vane array as set out in claim 1, wherein said second platform comprises a second contoured main body and further mounting lugs coupled to said second contoured main body.

10. The vane array as set out in claim 9, wherein said fourth connector structure comprises pins that extend through said further mounting lugs and are coupled to the vane carrier.

11. The vane array as set out in claim 10, wherein said further mounting lugs are located generally mid-way between said first and second airfoils.

12. The vane array as set out in claim 1, wherein at least one of the first and second platforms is contoured.

13. The vane array as set out in claim 12, wherein both of the first and second platforms is contoured.

14. A vane array adapted to be coupled to a vane carrier within a gas turbine engine comprising:

a plurality of elongated airfoils comprising at least a first airfoil and a second airfoil located adjacent to one another;

a U-ring;

first connector structure for coupling a radially inner end section of each of the first and second airfoils to said U-ring;

second connector structure for coupling a radially outer end section of each of the first and second airfoils to said vane carrier;

a platform extending between said first and second airfoils;

platform connector structure for coupling said platform to one of said U-ring and said vane carrier.

15. The vane array as set out in claim 14, wherein said radially inner end section of each of said first and second airfoils comprises connector arms extending radially inward.

16. The vane array as set out in claim 15, wherein said first connector structure comprises first connecting pins.

17. The vane array as set out in claim 14, wherein said radially outer end section of each of said first and second airfoils comprises connector hooks.

18. The vane array as set out in claim 14, wherein said platform comprises a contoured main body and mounting lugs coupled to said contoured main body.

19. The vane array as set out in claim 18, wherein said platform connector structure comprises pins that extend through said mounting lugs and are coupled to said one of said U-ring and said vane carrier.

20. The vane array as set out in claim 18, wherein said platform connector structure comprises corresponding slots in one of said U-ring and said vane carrier for receiving said mounting lugs.

* * * * *